US005463928A

United States Patent [19]

Boggavarapu et al.

[11] Patent Number: 5,463,928

[45] Date of Patent: Nov. 7, 1995

[54] ELECTRICAL POWER FEED ASSEMBLY FOR ELECTROTHERMAL GUN

[75] Inventors: Rao L. Boggavarapu, Bloomfield Hills, Mich.; Yeshayahu S. A. Goldstein, Gaithersburg, Md.; Catherine M. Keogh, Harrison Township, Macomb County, Mich.; Anthony J. Suchocki; Melvin M. Widner, both of Rochester Hills, Mich.

[73] Assignee: General Dynamics Land Systems, Inc., Sterling Heights, Mich.

[21] Appl. No.: 233,347

[22] Filed: Apr. 26, 1994

[51] Int. Cl.[6] ..... F41B 6/00

[52] U.S. Cl. ..... 89/8; 89/28.05

[58] Field of Search ..... 42/84; 89/1.814, 89/8, 28.05, 135

[56] References Cited

U.S. PATENT DOCUMENTS

| | | | |
|---|---|---|---|
| 1,303,266 | 5/1919 | Dougan | 89/28.05 |
| 1,897,863 | 2/1933 | Ruhlemann | 89/28.05 |
| 2,380,611 | 7/1945 | Quinnell et al. | 89/135 |
| 2,912,903 | 11/1959 | Crothers | 89/1.814 |
| 3,038,384 | 6/1962 | Gaugler | 89/28.05 |
| 3,427,924 | 2/1969 | Johnsen | 89/135 |
| 3,840,693 | 10/1974 | Honeycutt | 89/1.814 |
| 4,038,902 | 8/1977 | Welsh | 89/1.814 |
| 4,207,796 | 6/1980 | Warnock | 89/28.05 |
| 4,715,261 | 12/1987 | Goldstein et al. | 89/8 |
| 4,895,062 | 1/1990 | Chryssomallis et al. | 89/8 |
| 5,072,647 | 12/1991 | Goldstein et al. | 89/8 |
| 5,220,126 | 6/1993 | Borgwarth et al. | 89/28.05 |
| 5,233,902 | 8/1993 | Bernardes | 89/8 |
| 5,235,129 | 8/1993 | Corney | 89/28.05 |

FOREIGN PATENT DOCUMENTS

| | | | |
|---|---|---|---|
| 281460 | 12/1964 | Netherlands | 89/135 |

*Primary Examiner*—Stephen C. Bentley
*Attorney, Agent, or Firm*—Brooks & Kushman

[57] ABSTRACT

An electrical power feed assembly (12) for supplying high current to an electrothermal gun has first and second electrical connectors (38) and (42) with associated contact portions (40) and (44) for engaging and plastically deforming first and second side contacts (20,22) on a cartridge (14) to provide firing while maintaining the electrical contact without any arcing. The first connector (38) has a curved contact portion (40) that provides an interference fit to plastically deform the first contact (20) and establish the electrical contact as the cartridge (14) is inserted into the gun. The second connector (42) has a pair of curved knife edges (48) that engage and plastically deform the second contact (22) of the cartridge to establish and maintain the electrical contact under spring action of the second connector and by operation of a cam mechanism (50) of a breech block (26) of the gun. The cartridge (14) has its first and second contacts (20,22) made of a relatively soft material, copper and solder preferably, and has the contacts provided with annular shapes that are engaged by the contact portions (40,44) of the first and second connectors (38,42).

15 Claims, 2 Drawing Sheets

Fig. 2
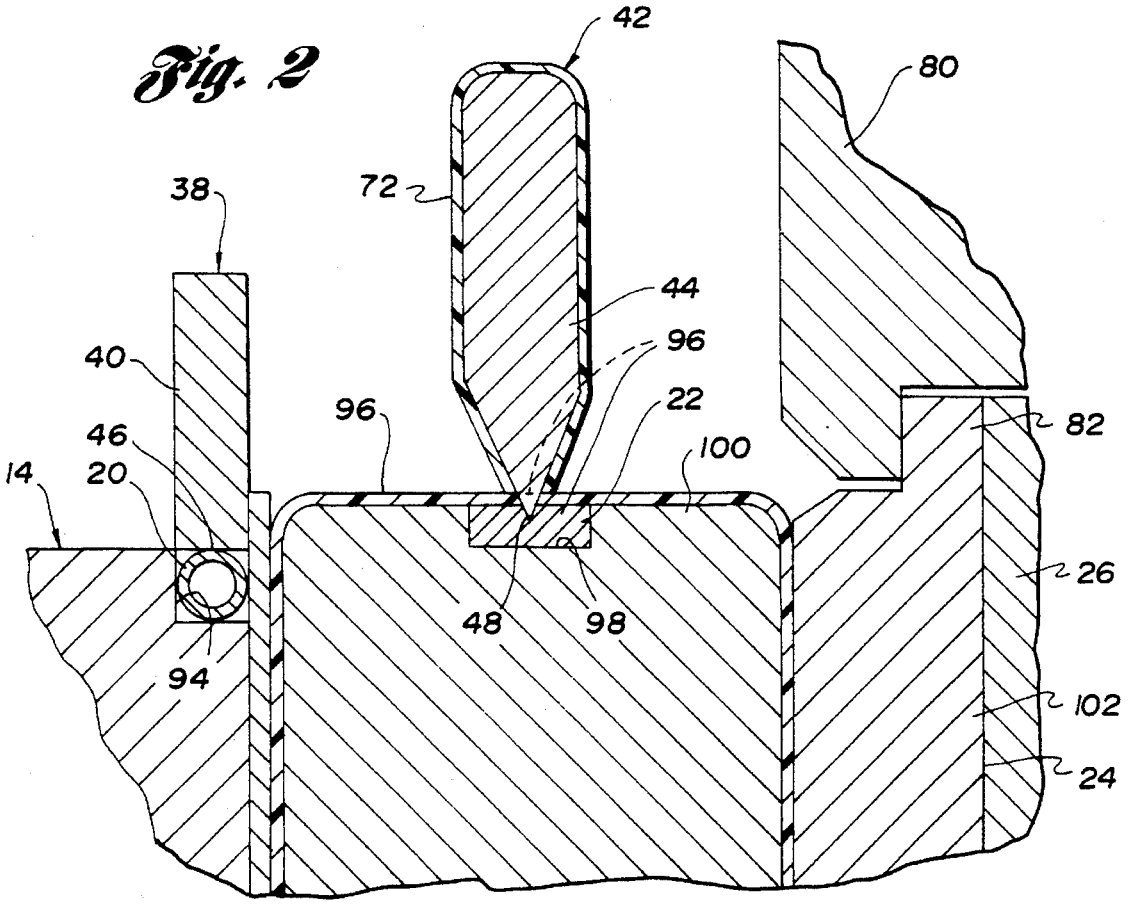
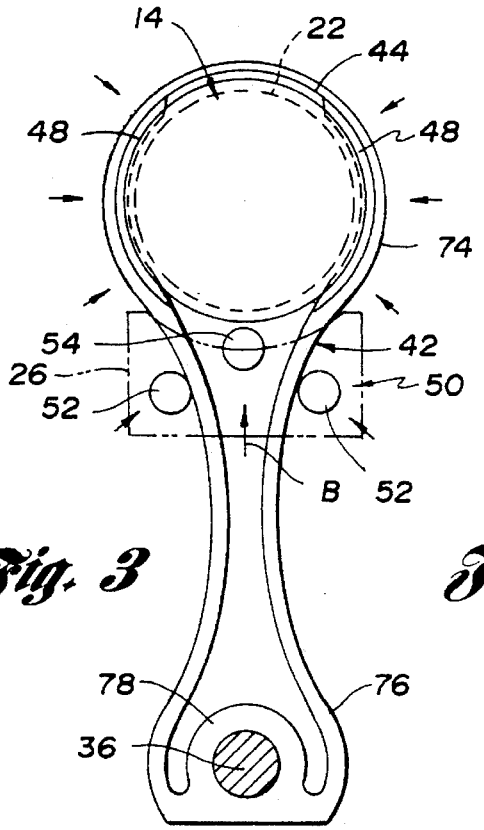
Fig. 3
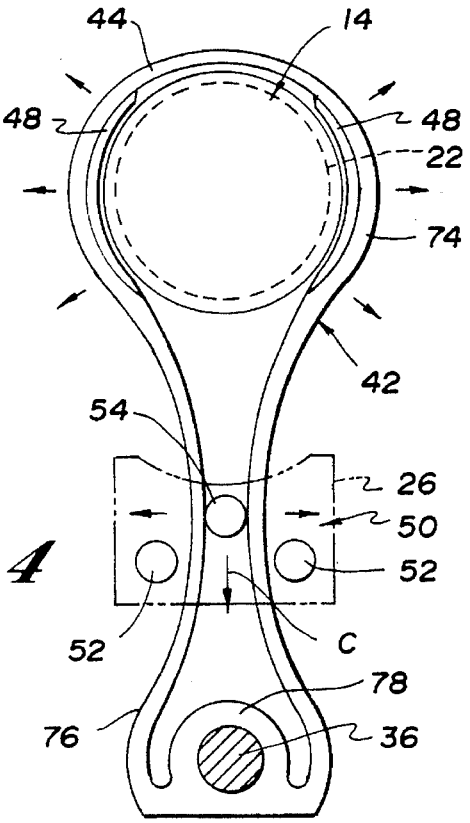
Fig. 4

ELECTRICAL POWER FEED ASSEMBLY FOR ELECTROTHERMAL GUN

TECHNICAL FIELD

This invention relates to an electrical power feed assembly for an electrothermal gun and also relates to a cartridge fired by the gun upon operation of the feed assembly.

BACKGROUND ART

A relatively low electrical voltage, such as about for example 28 volts, is conventionally utilized to fire gun primer and rocket ignitors. Prior electrical power feed assemblies which have been utilized to provide firing are disclosed by: U.S. Pat. Nos. 1,897,863 Ruhlemann; 2,380,611 Quinnell et al; 2,912,903 Crothers; 3,038,384 Gaugler; 3,427,924 Johnsen; 3,840,693 Honeycutt; and 4,207,796 Warnock; and by Netherlands Octrooiaanvrage No. 281460.

Over the last ten to fifteen years, electrothermal guns have been developed to provide firing of a projectile by generation of a plasma such as disclosed by U.S. Pat. Nos.: 4,715,261 Goldstein et al; 4,895,062 Chryssomallis et al; and 5,072,647 Goldstein et al. Such electrothermal guns normally require a voltage on the order of several kilovolts to produce a current flow of tens of kiloamps such as on the order of about 100 kiloamps in order to generate the plasma. This relatively high power results in problems such as heating, arcing, and electromagnetic separating and attractive forces between components that carry the electrical current.

DISCLOSURE OF INVENTION

Objects of the invention are to provide an electrothermal gun having an improved electrical power feed assembly and to also provide an improved cartridge that is fired by the electrothermal gun.

In carrying out the above objects, the electrothermal gun includes an elongated gun tube and a breech through which the electrothermal cartridge, which has first and second side contacts, is inserted into the gun tube. A breech closure of the gun is movable between an open position where the cartridge is inserted through the breech into the gun tube and a closed position where the cartridge is fired. An electrical recoil mechanism of the gun conducts electrical current upon recoil of the gun tube and breech. The electrical power feed assembly of the invention supplies current on the order of tens of kiloamps and greater to supply electrical power to the cartridge for firing. A first electrical connector of the feed assembly extends from the electrical recoil mechanism to the breech and has a contact portion for engaging and plastically deforming the first side contact of the cartridge to establish electrical contact with this contact. A second electrical connector of the feed assembly extends from the electrical recoil mechanism to the breech and includes a contact portion for engaging and plastically deforming the second side contact of the cartridge to establish electrical contact therewith such that an electrical current on the order of tens of kiloamps and greater flowing between the connectors through the cartridge provides firing of the cartridge with the plastically deformed contacts maintaining the electrical contact without any arcing. In addition, this construction of the feed mechanism is capable of handling the heat involved with the high current levels present and is also capable of maintaining the contact despite electromagnetic forces that result from the high current levels.

In the preferred construction of the electrical power feed assembly, the contact portion of the first electrical connector has a curved shape that forms an interference fit with the first side contact of the cartridge to provide plastic deformation thereof upon insertion of the cartridge into the gun tube through the breech. The curved contact portion of the first electrical connector as disclosed has an annular construction that provides its curved shape for forming the interference fit that plastically deforms the first contact of the cartridge.

In its preferred construction, the electrical power feed assembly has the contact portion of the second electrical connector provided with at least one knife edge that penetrates into the second contact of the cartridge to provide the plastic deformation that establishes the electrical contact between the second connector and the second contact of the cartridge. This knife edge preferably has a curved shape that penetrates the second contact of the cartridge to provide the plastic deformation thereof for establishing the electrical contact. As disclosed, the power feed assembly has the contact portion of the second connector provided with a pair of knife edges that penetrate into the second contact of the cartridge to provide the plastic deformation that establishes the electrical contact between the second connector and the second contact of the cartridge. The pair of knife edges most preferably have curved shapes that penetrate the second contact of the cartridge in an opposed relationship to provide the plastic deformation thereof for establishing the electrical contact between the second connector and the second contact of the cartridge.

In its preferred construction, the electrical power feed assembly includes a cam mechanism that provides a means for moving the contact portion of the second connector. This cam mechanism that provides the means for moving the contact portion of the second connector includes a closing cam that plastically deforms the second contact of the cartridge when the breech closure is moved to the closed position. An opening cam of the cam mechanism provides movement to disengage the electrical contact of the contact portion of the second connector with the second contact of the cartridge when the breech closure is moved to the open position.

In the preferred construction of the electrical power feed assembly disclosed, the breech closure is embodied by a breech block movable transversely with respect to the elongated direction of the gun tube between the open and closed positions. The contact portion of the second connector has a pair of opposed locations for engaging and plastically deforming the second contact of the cartridge. The cam mechanism that provides the means for moving the contact portion of the second connector includes a pair of spaced closing cams that respectfully clamp the first and second opposed location of the contact portion of the second connector to plastically deform the second contact of the cartridge to establish electrical contact when the breech block is moved to the closed position. The cam mechanism that provides the means for moving the contact portion of the second connector also includes an opening cam that moves the first and second opposed locations of the contact portion of the second connector out of electrical contact with the second contact of the cartridge when the breech block is moved to the open position. These first and second opposed locations of the contact portion of the second connector are curved knife edges that penetrate the second contact of the cartridge to establish the electrical contact when the breech block is moved to the closed position. The pair of knife edges move out of engagement with the second contact of the cartridge under the impetus of the opening cam to disengage the electrical contact when the breech block is moved to the open position.

In its preferred construction, the second connector includes an electrically insulative coating that provides electrical isolation thereof but which exposes the curved knife edges to provide the electrical contact with the second contact of the cartridge. More specifically, the second connector has a generally figure 8 shape having one loop which has the pair of curved knife edges exposed within the interior thereof, and the figure 8 shape has another loop which provides a mounting portion for providing securement thereof to the recoil mechanism. The loops of the figure 8 shape of the second connector are open to each other. The pair of closing cams engage the exterior of the Figure 8 shape of the second connector to establish the electrical contact of the pair of curved knife edges thereof with the second contact of the cartridge, and the opening cam engages the interior of the figure 8 shape of the second connector to disengage the electrical contact of the pair of curved knife edges thereof with the second contact of the cartridge.

In carrying out the objects of the invention, an electrothermal gun cartridge constructed in accordance with the invention is fired upon being supplied a current on the order of tens of kiloamps and greater and includes a casing having an elongated construction with a central axis and having a projectile end and a base end. A plasma generator of the cartridge is located within the casing extending from the base end thereof toward the projectile end of the casing. A propellent is provided within the casing, and a projectile is mounted by the projectile end of the casing. The base end of the casing has an axial face along the direction of the central axis and includes first and second side contacts that are connected to the plasma generator and that are engageable in a radial direction with respect to the central axis. Each of the side contacts is made of a relatively soft material that is electrically conductive and plastically deformable to establish electrical contact with an associated gun connector to fire the cartridge by energizing the plasma generator to provide a plasma that ignites the propellent to provide heating and pressurized gas that propels the projectile from the casing.

The electrothermal gun cartridge has each side contact preferably made from one of the materials of the group consisting of copper, solder, lead, indium and an electrically conductive plastic, and each of the side contacts preferably has an annular shape. One of the side contacts has a hollow construction. Furthermore, the base end of the casing has an insulative coating over one of the side contacts. More specifically, one of the side contacts is made of copper with an annular hollow shape, and the other side contact is made of solder with an annular shape and has the insulative coating that must be pierced by the associated connector of the gun to establish the electrical contact.

The objects, features and advantages of the present invention are readily apparent from the following detailed description of the best mode for carrying out the invention when taken in connection with the accompanying drawings.

BRIEF DESCRIPTION OF THE DRAWINGS

FIG. 2 is a sectional view taken through the base end of the cartridge to illustrate the manner in which first and second contacts thereof are engaged by contact portions of connectors of the electrical power feed assembly;

FIG. 3 is a view taken generally along the direction of line 3—3 in FIG. 1 and illustrates the manner in which electrical contact is established with one of the contacts of the cartridge; and FIG. 4 is a view similar to FIG. 3 but illustrates the manner in which an opening cam disengages the electrical contact with the one cartridge contact after firing.

BEST MODE FOR CARRYING OUT THE INVENTION

Figure 1:
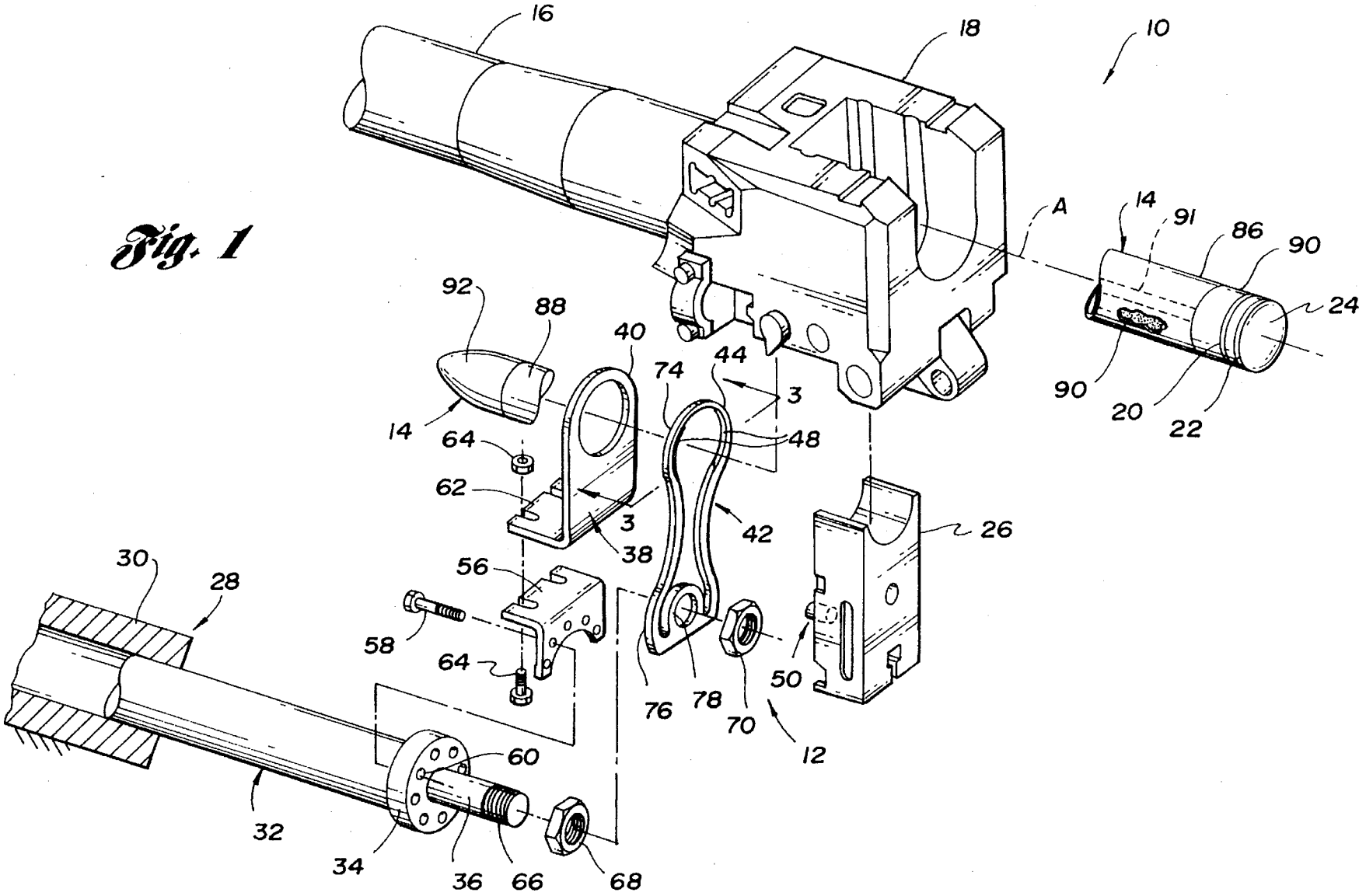
FIG. 1 is an exploded perspective view of an electrothermal gun having an electrical power feed assembly constructed in accordance with the invention to provide firing of a cartridge that is also constructed in accordance with the invention.

With reference to FIG. 1 of the drawings, an electrothermal gun 10 has an electrical power feed assembly 12 for applying a voltage on the order of several kilovolts to supply current on the order of tens of kiloamps and greater, such as about 100 kiloamps, to fire an electrothermal gun cartridge 14. The electrothermal gun 10 includes an elongated gun tube 16 and also has a breech 18 through which the cartridge 14 is inserted. This cartridge as is hereinafter more fully described has first and second side contacts 20 and 22 located forwardly from a rearwardly facing base surface 24 that is oriented axially with respect to the elongated direction of the gun tube and the central axis A of the cartridge. A breech closure 26 which is illustrated as being embodied by a breech block is movable between an open position where the cartridge 14 is inserted through the breech 18 into the gun tube 16 and a closed position where the cartridge is fired with the rearwardly facing base surface 24 of the cartridge engaged with the breech block which closes the rear of the gun tube 16. An electrical recoil mechanism 28 of the gun conducts electrical current upon recoil of the gun tube 16 and has a stationary support 30 that receives a slidable connector assembly 32 including first and second connector mounts 34 and 36 that are electrically isolated from each other across the voltage that is applied to the cartridge as is hereinafter more fully described. An unshown mechanical recoil mechanism of a conventional construction controls the recoil.

With continuing reference to FIG. 1, the electrical power feed assembly 12 of the gun for supplying current on the order of tens of kiloamps and greater includes a first electrical connector 38 extending from the electrical recoil mechanism 28 to the breech 18 and having a contact portion 40 for engaging and plastically deforming the first side contact 20 of the cartridge to establish electrical contact therewith as is hereinafter more fully described. A second electrical connector 42 of the electrical power feed assembly extends from the electrical recoil mechanism 28 to the breech 18 and includes a contact portion 44 for engaging and plastically deforming the second side contact 22 of the cartridge to establish electrical contact therewith such that an electrical current on the order of tens of kiloamps and greater flowing between the connectors through the cartridge provides firing of the cartridge with the plastically deformed contacts 20 and 22 maintaining the electrical contact without any arcing. The plastic deformation of the side contacts 20 and 22 in addition to maintaining the electrical contact without any arcing is also capable of withstanding the heat involved as well the large electromagnetic forces generated by the high level of electrical current involved. Furthermore, the construction facilitates making and breaking of the contacts in a convenient manner as is hereinafter more fully described.

As illustrated in FIG. 1, the contact portion 40 of the first connector 38 has a curved shape that forms an interference fit with the first side contact 20 of the cartridge 14 to provide the plastic deformation thereof upon insertion of the cartridge into the gun tube 16 through the breech 18. More specifically, the curved contact portion 40 of the first electrical connector 38 has an annular construction that provides its curved shape and has an inner diameter slightly smaller than the outer diameter of the first contact 20 which also has an annular shape. As such, the insertion of the cartridge 14 into the gun tube 16 causes a slight flattening of the first contact 20 at its outer extremity 46 by a plastic deformation as shown in FIG. 2 so as to maintain the contact.

With continuing reference to FIG. 2, the contact portion 44 of the second electrical connector 42 has at least one knife edge 48 that penetrates into the second contact 22 of the cartridge 14 to provide the plastic deformation that establishes the electrical contact between the second connector and the second contact of the cartridge. This knife edge 48 as also shown in FIGS. 3 and 4 has a curved shape that penetrates the second contact 22 of the cartridge to provide the plastic deformation thereof for establishing the electrical contact. In its preferred construction, the contact portion 44 of the second connector 42 includes a pair of knife edges 48 that penetrate into the second contact 22 of the cartridge to provide the plastic deformation that establishes the electrical contact between the second connector and the second contact of the cartridge. Both of the pair of knife edges 48 have curved shapes that penetrate the second contact 22 of the cartridge in an opposed relationship to provide the plastic deformation thereof for establishing the electrical contact, and the sizing is such that spring action of the second connector 42 causes the knife edges 48 to penetrate the second contact 22 even without the camming assist that is hereinafter described.

With combined reference to FIGS. 1, 3 and 4, a cam mechanism 50 mounted on the breech block type closure provides a means for moving the contact portion 44 of the second connector 42 to assist the spring action of the connector 42 in plastically deforming the second contact 22 of the cartridge 14 by the contact portion 44 when the breech closure embodied by the breech block 26 is moved to the closed position. As illustrated in FIG. 3, the cam mechanism 50 that provides the means for moving the contact portion 44 of the second connector 42 includes a closing cam 52, and in fact includes a pair of closing cams 52 as is hereinafter more fully described, for providing movement that assists spring action of the second connector 42 to plastically deform the second contact 22 of the cartridge by the contact portion 44 when the breech closure is moved to the closed position which corresponds to upward cam movement as illustrated by arrow B in FIG. 3. This movement takes place when the breech closure embodied by the breech block 26 is moved upwardly along the direction of arrow B to the closed position as previously described.

With reference to FIG. 3, the cam mechanism 50 that provides the means for moving the contact portion 44 of the second connector 42 also includes an opening cam 54 that provides movement against the spring action of connector 42 to disengage the electrical contact of the contact portion 44 of the second connector 42 with the second contact 22 of the cartridge when the breech closure embodied by the breech block 26 is moved to the open position which corresponds to movement along the direction shown by arrow C.

As illustrated in FIG. 1, the first connector 38 has an L-shaped bracket 56 that is secured to the first connector mount 34 by bolts 58, only one of which is shown, that are received by threaded mount openings 60. A flange 62 of the first connector 38 has slots which are aligned with slots of the bracket 56 to receive nut and bolt connections 64 that permit fore and aft adjustment so that the annular contact portion 40 can be properly adjusted.

As also shown in FIG. 1, the second connector mount 36 of the recoil mechanism 28 has a threaded end 66 that receives a first nut 68 for cooperating with a second jam nut 70 to mount the second connector 42 therebetween as is hereinafter more fully described. The location at which the second connector 42 is mounted on the threaded end 66 is thus also adjustable in a fore and aft direction as necessary to provide the proper location with respect to the first connector 38.

As previously mentioned in connection with FIG. 1, the breech closure is embodied by a breech block 26 that is movable transversely with respect to the elongated direction of the gun tube 16 between the open and closed positions with respect to the breech 18 through which the cartridge 14 is inserted. This insertion of the cartridge plastically deforms the first contact 20 as shown in FIG. 2 at its outer extremity 46. The contact portion 44 of the second connector 42 has a pair of opposed locations that are preferably provided at the knife edges 48 which each have a curved shape for engaging and plastically deforming the second contact 22 of the cartridge 14 under spring action of the second connector. The cam mechanism 50 for moving the contact portion 44 of the second connector 42 includes a pair of spaced closing cams 52 that respectively clamp the first and second knife edge locations 48 of the contact portion 44 of the second connector 42 to assist the spring action of the second connector in plastically deforming the second contact of the cartridge 14 to establish electrical contact when the breech block is moved to the closed position along the direction of arrow B as previously described.

As shown in FIG. 4, the cam mechanism 50 for moving the contact portion 44 of the second connector 42 includes the opening cam 54 that moves the first and second opposed knife edge locations 48 of the contact portion 44 of the second connector 42 out of electrical engagement with the second contact 22 of the cartridge 14 against the spring action of the second connector when the breech block 26 is moved in the direction of arrow C to the open position. The curved knife edges 48 that oppose each other as shown in FIGS. 3 and 4 penetrate the second contact 22 of the cartridge as shown in FIG. 2 under the impetus of spring action and the pair of closing cams 52 to establish the electrical contact when the breech block is moved to the closed position. Furthermore, the pair of curved knife edges 48 are moved out of engagement with the second contact 22 of the cartridge under the impetus of the opening cam 54 against the spring action of connector 42 to disengage the electrical contact when the breech block is moved to the open position.

As best illustrated in FIG. 2, the second connector 42 preferably includes an electrically insulative coating 72 such as from plastic that provides electrical isolation thereof but which exposes the curved knife edges 48 to provide the electrical contact with the second contact 22 of the cartridge as previously described.

As best illustrated in FIGS. 3 and 4, the second connector 42 has a generally figure 8 shape having one loop 74 which has the pair of curved knife edges 48 exposed within the interior thereof projecting inwardly from the insulative coating 72 as shown in FIG. 2. This figure 8 shape also has another loop 76 which includes a mounting portion 78 for providing securement thereof to the recoil mechanism 28 at the threaded end 66 of its second connector mount 36 shown in FIG. 1 in cooperation with the pair of nuts 68 and 70 previously described. The loops 74 and 76 of the figure 8 shape of the second connector 42 are open to each other, with the pair of closing cams 52 engaging the exterior of the figure 8 shape of the second connector adjacent the one loop 74 to assist spring action of the second connector in establishing the electrical contact of the pair of curved knife edges 48 with the second contact 22 of the cartridge as shown in FIG. 2, and with the opening cam 54 engaging the interior of the figure 8 shape of the second connector 42 as shown in FIG. 4 to operate against spring action in disengaging the electrical contact of the pair of curved knife edges 48 with the second contact 22 of the cartridge.

After the firing upon opening of the breech block 26, an extractor 80 of any conventional type engages a flange 82 of the cartridge base to extract the cartridge from the gun tube.

With combined reference to FIGS. 1 and 2, the electrothermal gun cartridge 14 of the invention is fired upon being supplied a current on the order of tens of kiloamps and greater, such as for example about 100 kiloamps. This cartridge 14 includes a casing 86 of an elongated construction along its central axis A and a round cross-section as is conventional. Casing 86 includes a projectile end 88 as well as a base end 90 adjacent which the first and second contacts 20 and 22 are located as previously described. Any suitable plasma generator 91 such as of the type disclosed by U.S. Pat. No. 5,072,647 may be utilized extending from the base end 90 of the casing and having suitable electrical connections to the contacts 20 and 22. A propellent 90 is received within the casing 86 and is made of a fuel and an oxidizer, such as aluminum particles and water provided as a slurry although other conventional propellants likewise may be utilized. The base end of the casing has the axial face 24 previously described along the central axis A facing rearwardly and includes the first and second side contacts 20 and 22 that are connected to the plasma generator and engageable in a radial direction with respect to the central axis A. Each of the side contacts 20 and 22 is made of a relatively soft material that is electrically conductive and plastically deformable to establish electrical contact with an associated gun connector to fire the cartridge by energizing the plasma generator 91 to provide a plasma that ignites the propellent 90 to provide heated and pressurized gas that propels a projectile 92 on the projectile end 88 of the casing.

Each of the side contacts 20 and 22 is made from a relatively soft metal that is electrically conductive and plastically deformable such as copper, solder, lead and indium or may also be made from an electrically conductive plastic. As previously mentioned, each side contact 20 and 22 has an annular shape. Furthermore, the one side contact 20 has a hollow construction and is preferably made from copper such as a copper tube that is bent around the casing and received within an annular contact groove 94. Furthermore, the base end 90 of the cartridge has an insulative coating 96 over the second contact 22 which is made of solder with its annular shape received within an annular groove 98 in a contact disc 100 of the casing base forward of an extractor disc 102 that defines the axially facing end surface 24 and the extractor flange 82. The entire disc 100 is covered by the insulative coating 96 such as plastic and is thus electrically separated from the casing portion adjacent the first contact 20. Furthermore, the coating 96 covers the entirety of the contact 22 until penetration therethrough by the knife edge 48 as the electrical contact is established in the manner previously described.

While the best mode for carrying out the invention has been described in detail, those familiar with the art to which this invention relates will recognize various alternative designs and embodiments for practicing the invention as defined by the following claims.

What is claimed is:

1. In an electrothermal gun including an elongated gun tube, a breech through which an electrothermal cartridge having first and second side contacts is inserted into the gun tube, a breech closure movable between an open position where the cartridge is inserted through the breech into the gun tube and a closed position where the cartridge is fired, and an electrical recoil mechanism for conducting current upon recoil of the gun tube and breech, an electrical power feed assembly for supplying current on the order of tens of kiloamps and greater to supply electrical power to the cartridge for firing, comprising: a first electrical connector extending from the electrical recoil mechanism to the breech and having a contact portion for engaging and plastically deforming the first side contact of the cartridge to establish electrical contact therewith; and a second electrical connector that extends from the electrical recoil mechanism to the breech and includes a contact portion for engaging and plastically deforming the second side contact of the cartridge to establish electrical contact therewith such that an electrical current on the order of tens of kiloamps and greater flowing between the connectors through the cartridge provides firing of the cartridge with the plastically deformed contacts maintaining the electrical contact without any arcing.

2. An electrical power feed assembly for an electrothermal gun as in claim 1 wherein the contact portion of the first electrical connector has a curved shape that forms an interference fit with the first side contact of the cartridge to provide the plastic deformation thereof upon insertion of the cartridge into the gun tube through the breech.

3. An electrothermal power feed assembly for an electrothermal gun as in claim 2 wherein the curved contact portion of the first electrical connector has an annular construction that provides its curved shape for forming the interference fit that plastically deforms the first contact of the cartridge.

4. An electrical power feed assembly for an electrothermal gun as in claim 1, 2 or 3 wherein the contact portion of the second electrical connector has at least one knife edge that penetrates into the second contact of the cartridge to provide the plastic deformation that establishes the electrical contact between the second connector and the second contact of the cartridge.

5. An electrical power feed assembly for an electrothermal gun as in claim 4 wherein the knife edge has a curved shape that penetrates the second contact of the cartridge to provide the plastic deformation thereof for establishing the electrical contact.

6. An electrical power feed assembly for an electrothermal gun as in claim 4 wherein the contact portion of the second connector includes a pair of knife edges that penetrate into the second contact of the cartridge to provide the plastic deformation that establishes the electrical contact between the second connector and the second contact of the cartridge.

7. An electrical power feed assembly for an electrical gun as in claim 6 wherein the pair of knife edges have curved shapes that penetrate the second contact of the cartridge in an opposed relationship to provide the plastic deformation that establishes the electrical contact between the second connector and the second contact of the cartridge.

8. An electrical power feed assembly for an electrothermal gun as in claim 1, 2 or 3 further including means for moving the contact portion of the second connector.

9. An electrical power feed assembly for an electrothermal gun as in claim 8 wherein the means for moving the contact portion of the second connector includes a closing cam that plastically deforms the second contact of the cartridge when the breech closure is moved to the closed position and also includes an opening cam that provides movement to disengage the electrical contact of the contact portion of the second connector with the second contact of the cartridge when the breech closure is moved to the open position.

10. An electrical power feed assembly for an electrothermal gun as in claim 8 wherein the breech closure is embodied by a breech block movable transversely with respect to the elongated direction of the gun tube between the open and closed positions, the contact portion of the second connector including a pair of opposed locations for engaging and plastically deforming the second contact of the cartridge, the means for moving the contact portion of the second connector including a pair of spaced closing cams that respectively clamp the first and second opposed locations of the contact portion of the second connector to plastically deform the second contact of the cartridge to establish electrical contact when the breech block is moved to the closed position, and the means for moving the contact portion of the second connector including an opening cam that moves the first and second opposed locations of the contact portion of the second connector out of electrical contact with the second contact of the cartridge when the breech block is moved to the open position.

11. An electrical power feed assembly for an electrothermal gun as in claim 10 wherein the first and second opposed locations of the contact portion of the second connector comprise curved knife edges that penetrate the second contact of the cartridge to establish the electrical contact when the breech block is moved to the closed position, and the pair of curved knife edges moving out of engagement with the second contact of the cartridge under the impetus of the opening cam to disengage the electrical contact when the breech block is moved to the open position.

12. An electrical power feed assembly for an electrothermal gun as in claim 11 wherein the second connector includes an electrically insulative coating that provides electrical isolation thereof but which exposes the curved knife edges to provide the electrical contact with the second contact of the cartridge.

13. An electrical power feed assembly for an electrothermal gun as in claim 12 wherein the second connector has a generally figure 8 shape having one loop which has the pair of curved knife edges exposed within the interior thereof, the figure 8 shape having another loop which includes a mounting portion for providing securement thereof to the recoil mechanism, the loops of the figure 8 shape of the second connector being open to each other, the pair of closing cams engaging the exterior of the figure 8 shape of the second connector to establish the electrical contact of the pair of curved knife edges thereof with the second contact of the cartridge, and the opening cam engaging the interior of the figure 8 shape of the second connector to disengage the electrical contact of the pair of curved knife edges thereof with the second contact of the cartridge.

14. In an electrothermal gun including an elongated gun tube, a breech through which an electrothermal cartridge having first and second side contacts is inserted into the gun tube, a breech block movable transversely with respect to the elongated direction of the gun tube between an open position where the cartridge is inserted through the breech into the gun tube and a closed position where the cartridge is fired, and an electrical recoil mechanism for conducting electrical current upon recoil of the gun tube and breech, an electrical power feed assembly for supplying electrical current on the order of tens of kiloamps to supply electrical power to the cartridge for firing, comprising: a first electrical connector extending from the electrical recoil mechanism to the breech and having a contact portion for engaging and plastically deforming the first side contact of the cartridge to establish electrical contact therewith upon insertion of the cartridge into the gun tube; a second electrical connector that extends from the electrical recoil mechanism to the breech and includes a contact portion; means for moving the contact portion of the second connector into engagement with the second side contact of the inserted cartridge to provide plastic deformation thereof to establish electrical contact therewith upon movement of the breech block to the closed position to supply electrical power to the cartridge for firing and for moving the contact portion of the second connector out of engagement with the second side contact of the cartridge upon movement of the breech block to the open position after firing for removal of the cartridge.

15. In an electrothermal gun including an elongated gun tube, a breech through which an electrothermal cartridge having first and second side contacts is inserted into the gun tube, a breech block movable transversely with respect to the elongated direction of the gun tube between an open position where the cartridge is inserted through the breech into the gun tube and a closed position where the cartridge is fired, and an electrical recoil mechanism for conducting electrical current upon recoil of the gun tube and breech, an electrical power feed assembly for supplying electrical current on the order of tens of kiloamps to supply electrical power to the cartridge for firing, comprising: a first electrical connector extending from the electrical recoil mechanism to the breech and having a contact portion for engaging and plastically deforming the first side contact of the cartridge to establish electrical contact therewith upon insertion of the cartridge into the gun tube; a second electrical connector that extends from the electrical recoil mechanism to the breech and includes a contact portion having a pair of curved knife edges; a pair of closing cams for assisting spring action of the second connector in moving the pair of curved knife edges of the contact portion of the second connector into engagement with the second side contact of the inserted cartridge to provide plastic deformation thereof to establish electrical contact therewith upon movement of the breech block to the closed position to supply electrical power to the cartridge for firing; and an opening cam for moving the pair of curved knife edges of the contact portion of the second connector against the spring action thereof out of engagement with the second side contact of the cartridge upon movement of the breech block to the open position after firing for removal of the cartridge.

* * * * *